US005133451A

United States Patent [19]

Boyd et al.

[11] Patent Number: 5,133,451

[45] Date of Patent: Jul. 28, 1992

[54] PROTECTIVE COIN HOLDER

[75] Inventors: Bruce D. Boyd, Sidney; Robert J. Geoghegan, Columbus; Barbara A. Metz, Baltimore; Karen L. Rosen; Richard D. Rosen, both of Hilliard, all of Ohio; Alex Bally, Pittsburgh, Pa.; Ronald J. Sears, Worthington, Ohio

[73] Assignee: AMCO Certification Services, Dublin, Ohio

[21] Appl. No.: 687,455

[22] Filed: Apr. 18, 1991

Related U.S. Application Data

[63] Continuation-in-part of Ser. No. 383,368, Jul. 20, 1989, Pat. No. 5,011,005.

[51] Int. Cl.[5] ..... A45G 1/00

[52] U.S. Cl. ..... 206/810; 206/45.34; 206/820

[58] Field of Search ..... 220/663; 206/0.8, 0.81, 206/0.82, 0.83, 0.84, 45.34

[56] References Cited

U.S. PATENT DOCUMENTS

| | | | |
|---|---|---|---|
| 2,457,998 | 1/1949 | Hayes et al. . | |
| 2,571,073 | 10/1951 | Stroop . | |
| 3,069,001 | 12/1962 | Burdick . | |
| 3,139,977 | 7/1964 | Burdick . | |
| 3,229,809 | 1/1966 | Spadaro . | |
| 3,241,659 | 3/1966 | Segel . | |
| 3,429,425 | 2/1969 | Hebert | 206/0.81 |
| 3,448,850 | 6/1969 | Segel et al. . | |
| 3,500,995 | 3/1970 | Korman . | |
| 3,611,604 | 10/1971 | Saltzman . | |
| 3,615,005 | 10/1971 | Segel et al. | 206/0.82 |
| 3,776,643 | 12/1973 | Titoff . | |
| 3,782,537 | 1/1974 | Segel | 206/0.82 |
| 3,788,464 | 1/1974 | Skinner . | |
| 4,063,639 | 12/1977 | Grant . | |
| 4,165,573 | 8/1979 | Richards . | |
| 4,320,831 | 3/1982 | Szabo et al. | 206/0.82 |
| 4,364,472 | 12/1982 | Waldmeier | 206/45.34 |
| 4,378,876 | 4/1983 | Szabo et al. . | |
| 4,385,688 | 5/1983 | Grant | 206/0.82 |
| 4,485,916 | 12/1984 | Krejcik | 206/45.34 |
| 4,592,465 | 6/1986 | Stein . | |
| 4,595,095 | 6/1986 | Lam | 206/45.34 |
| 4,602,447 | 7/1986 | Feingold . | |
| 4,805,680 | 2/1989 | Zieno | 220/663 X |
| 4,878,579 | 11/1989 | Hager . | |
| 4,915,214 | 4/1980 | Wieder | 206/0.82 |

FOREIGN PATENT DOCUMENTS

| | | | |
|---|---|---|---|
| 245472 | 2/1966 | Austria | 206/45.34 |
| 458347 | 7/1949 | Canada | 206/45.34 |
| 0100911 | 2/1984 | European Pat. Off. | 206/0.83 |
| 1511150 | 9/1978 | Fed. Rep. of Germany . | |
| 2358857 | 3/1978 | France | 206/0.82 |
| 2421818 | 12/1979 | France | 206/45.34 |
| 845561 | 8/1960 | United Kingdom | 206/45.34 |
| 2222143 | 2/1990 | United Kingdom | 220/663 |

OTHER PUBLICATIONS

NGC Coin Holder, Advertised in Coin World on Wed., Jan. 18, 1989.

Anacs Cache advertised in Coin World on Wed., Feb. 8, 1989 at p. 29.

Hallmark Coin Holder advertisement, undated.

PCGS Coin Holder advertisements, copyright 1990.

PCI Coin Holder advertisement, dated Mar. 21, 1990.

Blanchard advertisement showing PCGS Coin Holders dated Apr. 27, 1990.

*Primary Examiner*—William I. Price

*Attorney, Agent, or Firm*—Killworth Gottman Hagan & Schaeff

[57] ABSTRACT

An improved container for the storage, display and protection of collectable items such as graded coins, stamps, jewels and other valuables is disclosed. Display of the collectable items is enhanced by an optical element which provides reflective means for viewing the item indirectly. A reflecting prismatic ring is preferred to provide viewing of the periphery of a cavity or the collectable item enclosed therein. In a second embodiment where two or more components may completely enclose the cavity, various tamper-resistant and tamper-evidencing features are further incorporated in the container design to discourage and prevent fraudulent substitutions of collectable items, modification of grade and value certificates enclosed therewith, or counterfeiting of container components.

69 Claims, 9 Drawing Sheets

50
51a
51d
30
13
51c
42
61a
62
61d
51e
61c
54
13
61e
56
61f
49
36
38
38
38
49
66
60
14a
12
26
16
49
46
61b
49
42
58
64

PROTECTIVE COIN HOLDER

CROSS-REFERENCE TO RELATED APPLICATIONS

This is a continuation-in-part of U.S. application Ser. No. 383,368, filed Jul. 20, 1989, now U.S. Pat. No. 5,011,005, issued Apr. 30, 1991, the disclosure of which is hereby incorporated by reference.

BACKGROUND OF THE INVENTION

The present invention relates to a container, and more particularly to a tamper-resistant, tamper-evident container for collectable items which includes an optical element for viewing the collectable items contained therein from the side.

Containers, such as coin holders, stamp holders, and cases for jewels, gems or jewelry, are used by numismatists, collectors, investors and the like to protect, store, and display their coins, stamps and other collectable items.

There has been an increasing interest in the preservation, display and protection of various collectable items. Existing containers, however, are not entirely suitable for some collectors, for example numismatists. Typically, two-piece plastic holders are known which snap together to hold a coin in a transparent, recessed center portion which is molded into the holder. The pieces may simply be snapped apart and the coin removed to permit direct, physical inspection. While suitable for preservation and display, a drawback of this type of holder is that direct inspection of all coin surfaces may require removal of the coin, and undesirable manipulation of the coin by hand.

The increasing value and desirability of coins as investments has engendered growing interest in the protection of valuable coins, as well as in the accurate grading and authentication of coins. Grading services have, accordingly, entered the marketplace with coin holders of various designs which also include grading information. These holders are designed to permanently retain coins, along with corresponding grading information for that coin, thus providing a means of assuring future owners that the coins in the holders are of the indicated grades. Similarly, a need exists for grading, value, authentication, or other information to accompany containers used for stamps., jewels, gemstones and other collectable items.

Concerns have arisen with the possibilities for fraud through undetected access to such containers, which would allow the coins, stamps, and the like to be switched or the information contained in grading, value, authentication or other certificates to be altered. Similarly, concerns exist with wholesale counterfeiting of such containers and certificates.

To this end, known coin holders used by some grading services contain holograms of symbols or logos in an attempt to insure authenticity of the product. Such holders are made of hard plastic and have sealed edges for security. A functional disadvantage of such designs is that they do not allow direct viewing of the coin's surfaces, and scratches and defects in the transparent coin holder can often be misinterpreted as imperfections in the subject coin. Further, in coin holders of this type, the rim of the coin cannot be clearly viewed or evaluated.

Because of the significant impact grading has upon the value of coins, stamps, jewels and other collectable items, and the possibilities for fraud, the need remains for improved, secure containers which, nonetheless, permit display and complete inspection of the item therein. Complete inspection includes the possibility of direct and unobstructed viewing the surfaces, as well as a clear view of the edge of the item.

SUMMARY OF THE INVENTION

The present invention meets those needs by providing a container for collectable items, in particular coins, which protects an item from inadvertent damage; secures the item along with a certificate from undetected tampering; provides viewing of opposing surfaces and the periphery of the cavity; and in at least one embodiment, permits the item to be directly inspected and manipulated without the item itself being directly touched.

The container of the present invention may be made of one or more container components, and includes one or more cavities for retaining a collectable item(s), and means for reflectively transmitting an image of the cavity from the periphery of the cavity for viewing by an individual. For simplicity, the means for reflectively transmitting an image from the periphery of the cavity for viewing by an individual is, hereafter, referred to as "reflective means for viewing". The reflective means for viewing transmits an image of all or part of the cavity (or cavities) and the collectable item(s) therein. At least a portion of the cavity or cavities. In a first embodiment, the container is made of one piece, preferably a reflecting prismatic ring, which includes one or more cavities, preferably a single cylindrical cavity extending centrally therethrough. Specific means for retaining an item in a cavity may also be provided to accommodate various collectable items which may be placed therein.

A reflecting prism is a prism which may be used in place of a mirror for deviating light. Light entering therein typically undergoes one internal reflection. Reflecting prisms, as with all prisms, may have 3, 4, 6, 8 or 12 faces, with face intersection edges being parallel. A reflecting prismatic ring is a ring-shaped prism. In accordance with the present invention, the reflecting prisms discussed will, representatively, have three faces, although prisms with 4, 6, 8 or 12 faces may be used.

The reflective means for viewing reflects a view from the periphery of the cavity to at least one face of the container, and provides an indirect or lateral view of the cavity as well as the item placed therein. In addition to a reflecting prismatic ring, the reflective means for viewing could, alternatively, be a reflecting prism having straight sides, curved sides, or both, and may have one or more straight, concave, or convex faces. Reflective means for viewing may also be a body with a coated or mirrored surface. The reflective means for viewing may surround a portion of, or all of, the cavity, providing a partial or complete view of the periphery of the cavity.

In a second embodiment of the present invention, the container is comprised of two or more container components, and includes one or more cavities defined by at least one of the components and one or more reflective means for viewing. The cavities and reflective means are as previously indicated. Where two or more container components are provided, one or more outer covers may enclose all or part of the cavity, include an opening or aperture thereto, or may completely enclose the reflective means for viewing.

Thus, in the second embodiment where at least two container components are provided, a more secure structure for a collectable item may result. That is, means for preventing undetected separation of container components, or means for preventing undetected access to the cavity or certificate may be used where opposing container component surfaces are presented.

In its preferred configuration, the second embodiment preferably includes an outer cover and an inner element inserted and secured in the outer cover. The inner element includes a cavity in which a collectable item, such as a coin, is placed, and further includes a reflective means for viewing the cavity and item therein. A certificate of grade, authenticity, or other indicia may also be provided in the inner element. Preferably, when the inner element is removed from the outer cover, the surfaces of the item may be viewed and inspected in an unobstructed manner through openings or viewing apertures to the cavity in the inner element. Further, the item and the certificate are, preferably, sufficiently retained in the inner element to inhibit their undetected removal through such opening or viewing aperture.

When the inner element is inserted into the outer cover, the container preferably entirely encloses the cavity and protects the collectable item from inadvertent damage. Thus, for example, when a coin is secured in the container, the obverse and reverse surfaces of the coin may be viewed through transparent portions of the outer cover. Information appearing on a grading certificate, whether on the top or bottom surfaces thereof or along its edges, may also be viewed through transparent portions of the outer cover.

Regardless whether the inner element is enclosed or removed from the outer cover, the periphery of the cavity and item therein may be viewed from at least one viewing position or one viewing face of the container by the reflective means for viewing. If, for example, the reflective means for viewing is one reflecting prismatic ring, one viewing face would present an annular viewing area simultaneously showing the entire periphery of the item. Where, for example, two prismatic rings were used, opposing viewing faces could each present an annular viewing area of a portion of the cavity and item. Thus, for example, where a coin is placed in the cavity, inspection of the edges is possible. Where a reflecting prismatic ring is used, the reeded edge of a coin will reflect to cause an aesthetically pleasing design about the viewing face.

Where two or more container components are provided, a variety of means may be used to detect the separation or disassembly of the container components and to prevent undetected access to and substitution of inferior items or substitution or alteration of grading, authentication or other certificates. Such means for preventing undetected access include using tamper-evident devices or means, such as thin-film tapes or optically variable coatings, and or other related devices or means which are disrupted or destroyed when surfaces in contact therewith are separated; mechanical package design that includes complex and detailed features difficult to counterfeit or reproduce; and grading certificate design.

Thin-film tapes, or optically variable coatings or other related devices or means may be used at points where the outer cover engages the inner element upon initial insertion of the inner element. Such tapes, coatings or devices irreversibly disrupt, destroy, become unreadable or change color when the inner element is subsequently removed from the outer cover and, thus, comprise tamper-evident means for permanently indicating separation of two or more container components. In similar fashion, the thin-film tapes, optically variable coatings or devices may be used at points of contact between inner element components which are joined to form the inner element. Again, such tamper-evident devices or means will irreversibly indicate separation of attached inner element components, as might occur in an attempt to gain access to either the collectable item or related certificate.

Other means for preventing undetected access to the cavity, item or certificate are provided. Mechanical package design may serve to protect against undetected access as well as inhibit counterfeiting of the subject container or container components. For example, joints between container components may be joined by ultrasonic bonding methods. Additionally, metal pins may be located in the inner element components at the joints between its components to discourage access to the coin or grading certificate by hot-wire or other cutting methods. Pins of non-circular cross section, dimensioned so as to not penetrate the outer surfaces of the inner element, are preferable to prevent their removal by drilling.

Further in this regard, the container components, such as the inner element container components, may be designed so that disassembly of the components renders those components unusable. By selectively weakening specific areas of those components and joining them with ultrasonic bonds at points around the periphery of the viewing aperture, separation of container components results in fracture thereof. Finally, a sheet material, such as a paper grading certificate, may be placed between and adhered to two or more container components which will be destroyed upon separation of container components, leaving, as well, residue on the surfaces of the components.

Further means to prevent counterfeiting of the container components may include areas of design on one or more container components. For example, a frosted, etched or milled design of complex or detailed features may be located on the inner surface of a container component, for example, an annular area of design around an opening, viewing aperture or viewing face. Typically, these features are introduced into the container during molding of the specific plastic components, where the complex design features have been etched into the mold cavity for transfer to the plastic part. The inside edges of the viewing apertures may also have a design placed upon them.

Indicia may be printed or placed on the container components, various tamper-evident means, or on sheet material, which preferably also forms a certificate. Grading, authentication or other informational certificates may be made of any sheet material upon which indicia may be registered. Tampering or counterfeiting of such certificates is resisted by placing adhesives on both sides of the certificate and assembling it in layered or "sandwich" style between container components, such as between the inner element components. The certificate is torn and destroyed when the components are separated. Further, when paper sheet material is used, the use of bleeding inks or laser printing on either security paper or paper having dyed designs will discourage alteration since the certificate substrate will be irreversibly changed through such processes. The information placed on the grading certificates may also be obliterated upon separation of container components by placing clear adhesives on the certificates at the points where information is printed thereon. Alternatively, the same result may be achieved by printing indicia on thin-film tapes, or on optically variable coatings or devices which will be irreversibly and visually damaged when the inner element components are separated.

DETAILED DESCRIPTION OF THE PREFERRED EMBODIMENT

Figure 1:
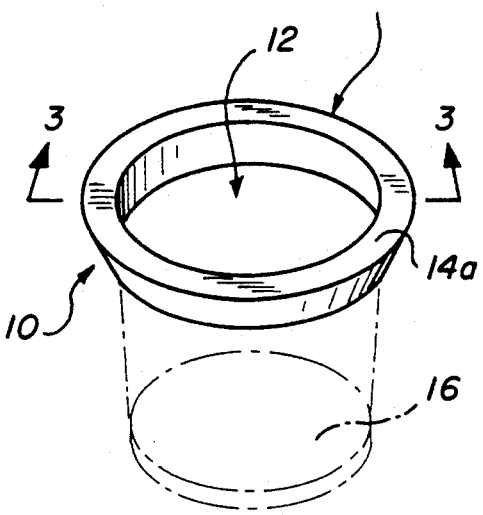
FIG. 1 is a front perspective view of the first embodiment of the container of the present invention in its fist, preferred configuration.

Referring to FIG. 1, the container 10 of the present invention is shown in its first, preferred embodiment. The container 10 is made of one piece which includes a cavity 12 extending generally centrally therethrough. Means for reflectively transmitting an image from the periphery of the cavity for viewing by an individual surrounds at least a portion of cavity 12 wherein a collectable item 16 may be placed. For simplicity, the means for reflectively transmitting an image from the periphery of the cavity for viewing by an individual is, hereafter, referred to as "reflective means for viewing. As shown in the preferred embodiment of FIG. 1, reflective means for viewing comprises reflecting prismatic ring **14*a* completely surrounding cavity 12**.

Reflective means for viewing 14 is one species of optical elements 15 which transmit an image for viewing the cavity 12. Optical elements 15, indicated representatively in FIGS. 1 and 8, may comprise reflective means for viewing 14, shown in various embodiments in FIGS. 1–14 as elements **14*a*–14*m*; magnifying lenses 33, shown in FIG. 8 as element 33*a*; refractive means for viewing; combinations of reflective means for viewing, magnifying lenses, and refractive means for viewing; or may comprise other optical elements which may be used to view the cavity 12**.

Figure 2:
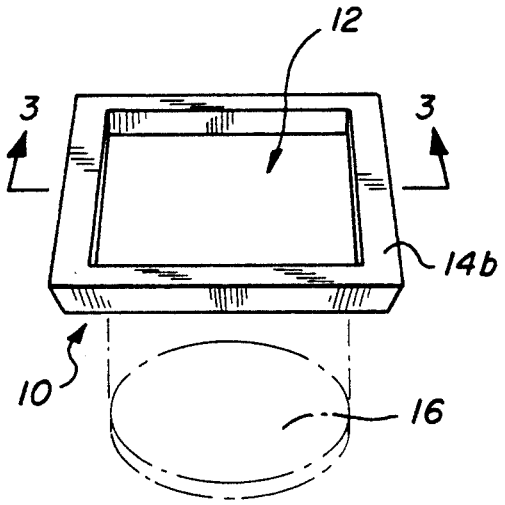
FIG. 2 is a front perspective view of the first embodiment of the container of the present invention in a second configuration.
Figure 3:
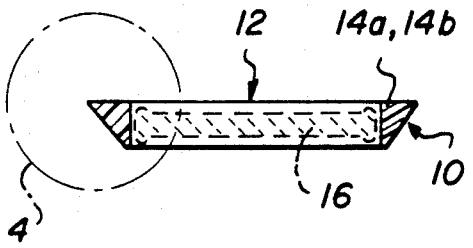
FIG. 3 is a cross-sectional view of the first embodiment of the container of the present invention taken along lines 3—3 in FIG. 1 and FIG. 2.
Figure 4A:
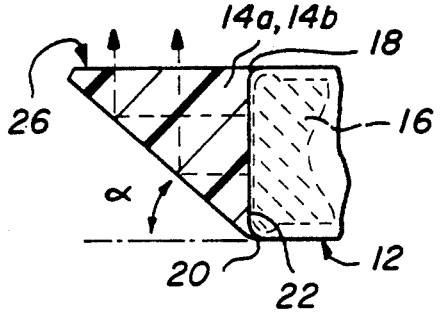
FIG. 4A is an enlarged detail of area 4 from FIG. 3.

In a second configuration, reflective means for viewing includes a reflecting prism having one or more straight sides, for example, square reflecting prism **14*b*, shown in FIG. 2. Applicable to either configuration, a cross-sectional view of container 10 is shown in FIG. 3, holding collectable item 16. As shown in FIG. 4A, collectable item 16 is retained in container 10 by nubs 18, 20 which may be formed by plastic deformation of the walls of cavity 12 when coin 16 is placed in container 10, or may be a permanent feature formed along the periphery 22 of cavity 12, such as fixed nubs or tabs. Fixed nubs 18, 20 are preferred when the cavity is formed by more rigid materials, discussed more fully below. Nubs 18, 20 may be formed by plastic deformation of the walls of cavity 12 where more flexible materials, discussed below, are used. As shown in FIG. 4A, regardless of how formed, the nubs 18, 20 create a pocket into which the coin can be snapped for suspension in the container 10**, and provide a degree of annular protection for the edge of the coin.

FIGS. 1 and 2 illustrate that where a reflecting prism is used, as long as the prism is constant in cross section or the prism face intersections remain parallel, any shape is possible, and will provide a view of cavity 12 or item 16 defined or contained therein. To illustrate this principle, alternative configurations may take various other shapes including curved and straight sides, as representatively shown in FIGS. 5D-5G. It is understood that a reflecting prism may, therefore, be provided to fit the shape of many regular, as well as irregular items 16 or to form regular or irregular cavities 12.

Figure 5A:
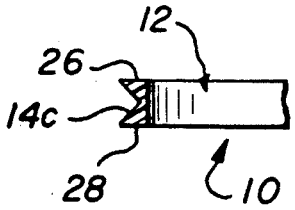
FIG. 5A is a cross-sectional view of the first embodiment of the container of the present invention in a third configuration.
Figure 5B:
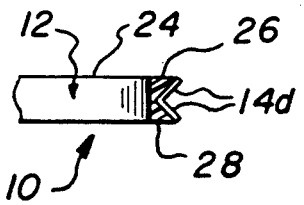
FIG. 5B is a cross-sectional view of the first embodiment of the container of the present invention in a fourth configuration.
Figure 5C:
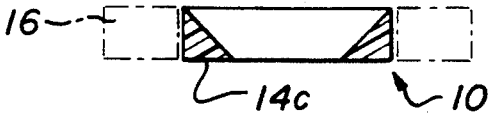
FIG. 5C is a cross-sectional view of the first embodiment of the container of the present invention in a fifth configuration.
Figure 5D:
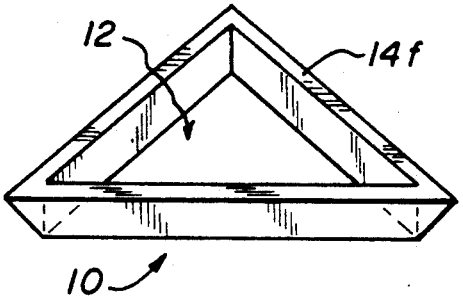
FIGS. 5D–5G are schematic perspective views of the first embodiment of the container of the present invention illustrating alternative shapes for alternative configurations.
Figure 5E:
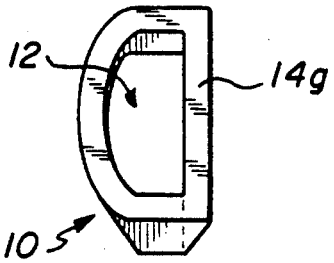
Figure 5F:
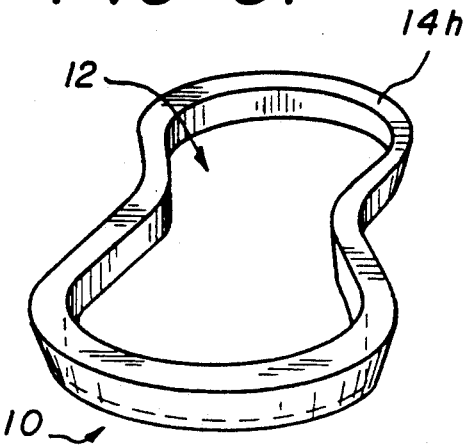
Figure 5G:
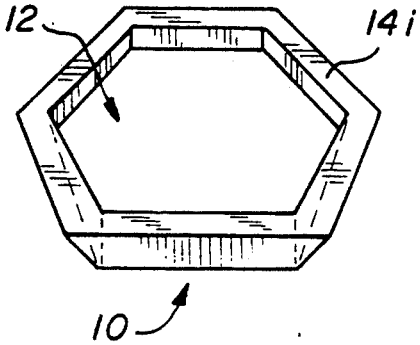

Third, fourth, and fifth configurations of the first embodiment of container 10 are shown in FIGS. 5A-5C, respectively. In FIG. 5A the reflective means for viewing comprises a double reflecting prism 14c. In FIG. 5B the reflective means for viewing comprises one or more coated or mirrored surfaces 14d of body 24, shown representatively as having a double angle in cross-section. Where mirrored surfaces 14d are provided, they may be variously disposed or configured, and thus may be on other surfaces, such as mating surface 34a of FIG. 7, so long as the mirrored surface 14d is positioned to reflect a view of cavity 12. In FIG. 5C, reflective means for viewing are disposed in the center of a ring-shaped item 16, illustrating that, in accordance with the present invention, container 10 need not encircle the item to be viewed.

Figure 4B:
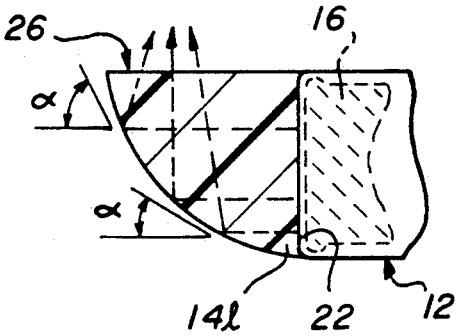
FIG. 4B is an enlarged cross-sectional detail of a reducing reflecting prism in accordance with the present invention.
Figure 4C:
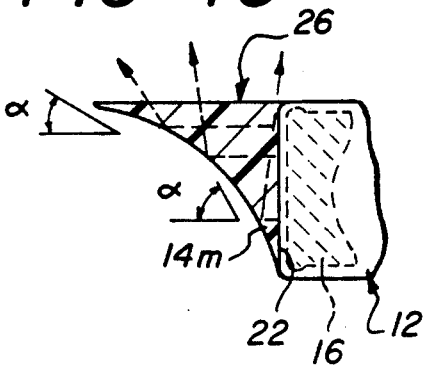
FIG. 4C is an enlarged cross-sectional detail of a magnifying reflecting prism in accordance with the present invention.

As shown in FIG. 4A-4C, reflective means for viewing 14 provides a lateral or indirect view of both the periphery 22 of cavity 12, as well as a view of collectable item 16 therein. This view, represented by dashed arrows, is reflected to first viewing face 26 of container 10. As shown in the third and fourth configurations of FIGS. 5A and 5B, a partial view of cavity 12 could also be reflected to both first and second viewing faces 26 and 28. Regardless of the configuration, it is understood that reflective means for viewing 14 not only permits viewing cavity 12 or item 16, but permits viewing a label, certificate 36, indicia 38 or the like, placed along the edge of cavity 12 or item 16. Similar viewing by reflection is also possible with mirrored surface 14d.

Where reflective means for viewing 14 comprise a reflecting prism, for example, reflecting prisms 14a, 14b, 14c, 14e-14i, 14l-14m shown in FIGS. 1, 2, 5A, 5C-5G, and 4B-4C, respectively, the reflecting prism is preferably comprised of a substantially transparent material having a suitable index of refraction and capable of internal reflection, such as polymers or copolymers of acrylic or methacrylic acid such as polymethyl methacrylate, or polycarbonate. Other suitable materials include other substantially transparent thermoplastics, thermoset resins, acetal resins, silicones, epoxy resins, glass and the like. Where coated or mirrored surface, such as surfaces 14d in FIG. 5B, are provided, any material that can hold and maintain a reflective coating or polish, such as steel, glass, plastics, thermoset or thermoplastic resins are suitable. However, a silvered, mirrored surface is preferred.

Where reflective means for viewing 14 comprises a reflecting prism, the prism may be linear on all sides, as shown in FIG. 4A, or non-linear, as shown in FIGS. 4B and 4C, to provide reduction or enlargement of the view of cavity 12 or item 16. Angle $\alpha$, shown best in FIG. 4A, is that angle which provides optimal internal reflection consistent with the index of refraction for the chosen material. For most materials angle $\alpha$ is generally from 35 degrees to 55 degrees, and is preferably 45 degrees for reflecting prisms such as shown in FIG. 4A.

A second embodiment of the present invention is shown in FIGS. 6-12, and 23, where container 30 is made of two or more container components. As representatively shown in the first, second, and third configurations of FIGS. 6, 7 and 8, respectively, container 30 includes first and second covers 32 and 34, respectively. First and second covers 32 and 34 enclose cavity 12, enabling collectable item 16 to be completely sealed therein. Preferably, first and second covers 32, 34 are transparent. Where cavity 12 has only one opening, as in FIG. 8, only a first cover 32 is required.

Figure 6:
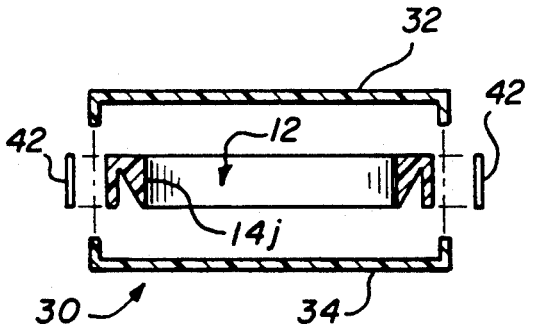
FIG. 6 is a cross-sectional view of the second embodiment of the container of the present invention in a first configuration.
Figure 7:
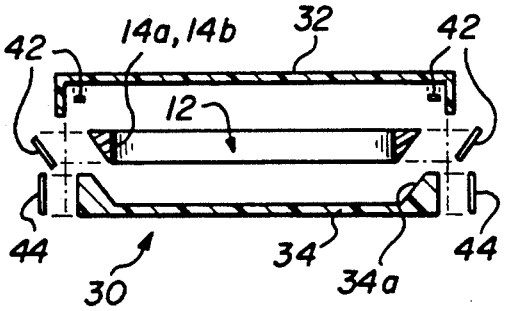
FIG. 7 is a cross-sectional view of the second embodiment of the container of the present invention in a second configuration.
Figure 8:
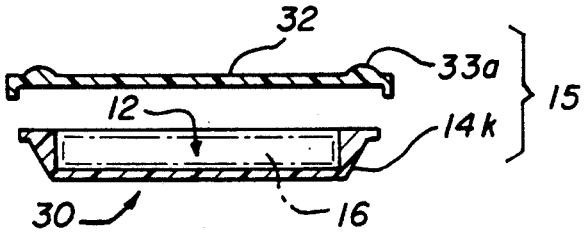
FIG. 8 is a cross-sectional view of the second embodiment of the container of the present invention in a third configuration.

The various configurations of the second embodiment shown in FIGS. 6, 7 and 8 include, respectively, alternative reflective means for viewing 14j, 14a or 14b, and 14k. Reflective means 14j and 14k, as with 14a and 14b, if standing alone, would comprise alternative one piece configurations of the first embodiment. These alternative reflective means are preferably made of the same materials and configured with the same angle $\alpha$, as previously discussed. Again a variety of shapes are possible.

The third configuration of FIG. 8 includes another optical element 15 for viewing the cavity 12. The optical element 15 is representatively shown in FIG. 8 comprising an annular magnifying lens 33a on first cover 32 in combination with reflective means for viewing 14k. Alternatively, although not shown, magnifying lens 33 could cover the entire upper surface of first cover 32. Thus, FIG. 8, is representative of a container 30 including an optical element 15. As illustrated in FIG. 8, such optical elements permit laterally viewing or indirectly viewing cavity 12 and at least a portion of a collectable item 16 therein.

Figure 12:
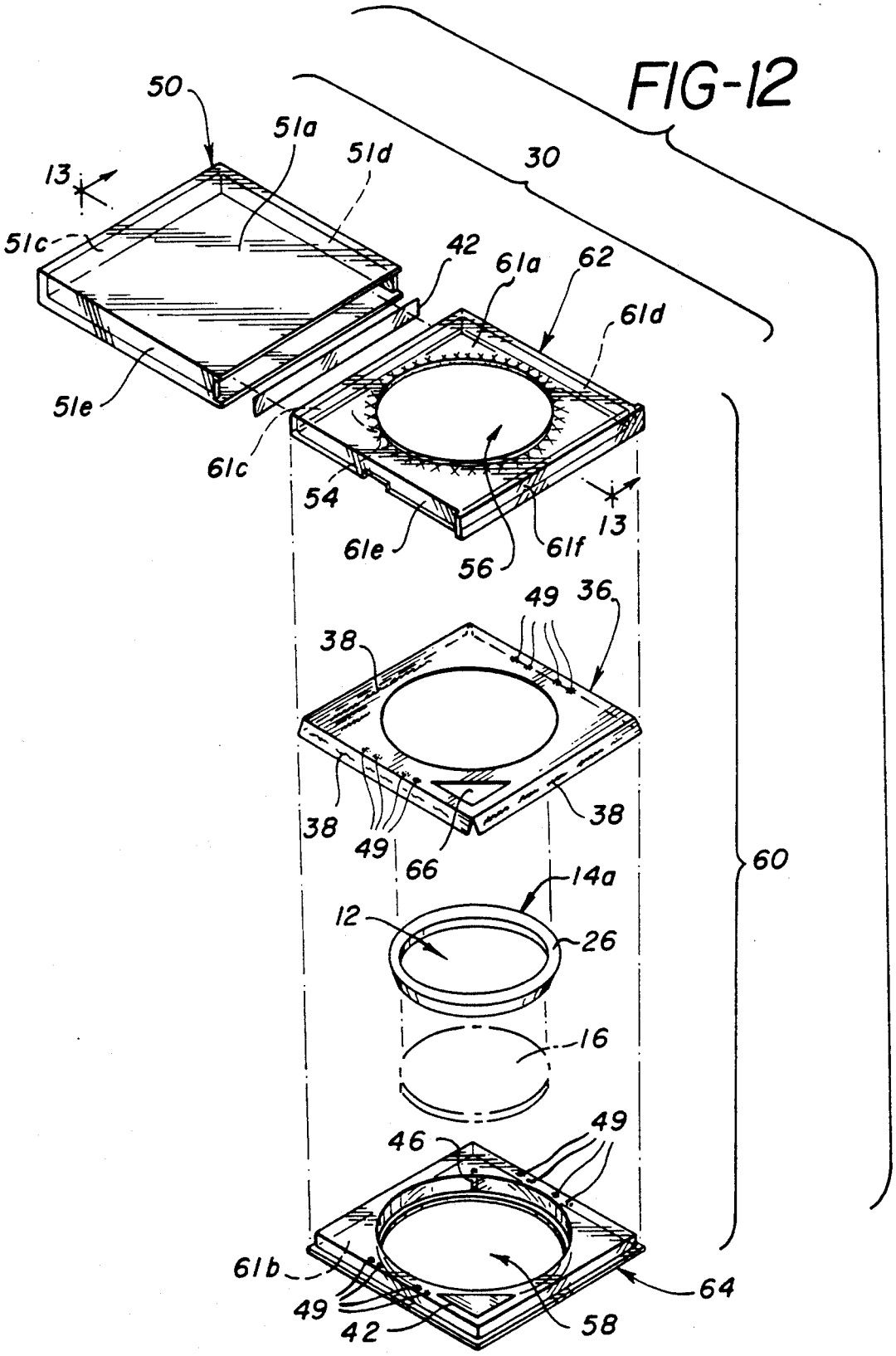
FIG. 12 is an exploded perspective view of the second embodiment of the container of the present invention in a seventh, preferred configuration.
Figure 13:
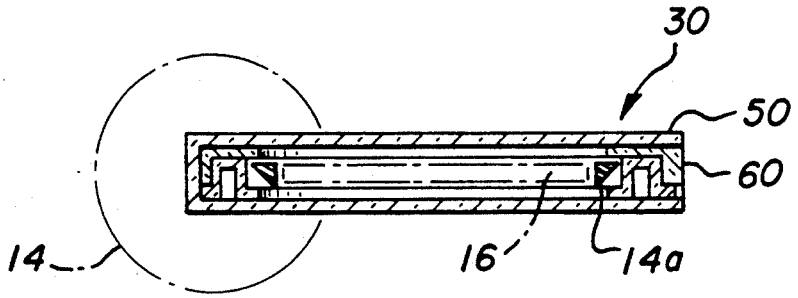
FIG. 13 is a cross section of the assembled container of FIG. 12 at line 13—13.
Figure 14:
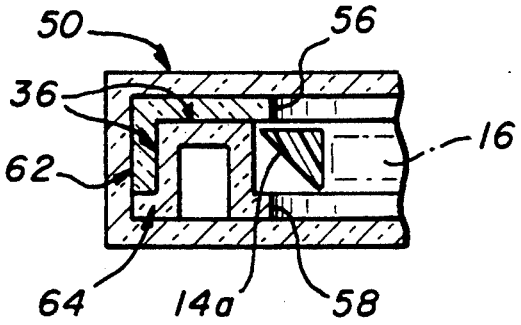
FIG. 14 is an enlarged detail of area 14 from FIG. 13.
Figure 15:
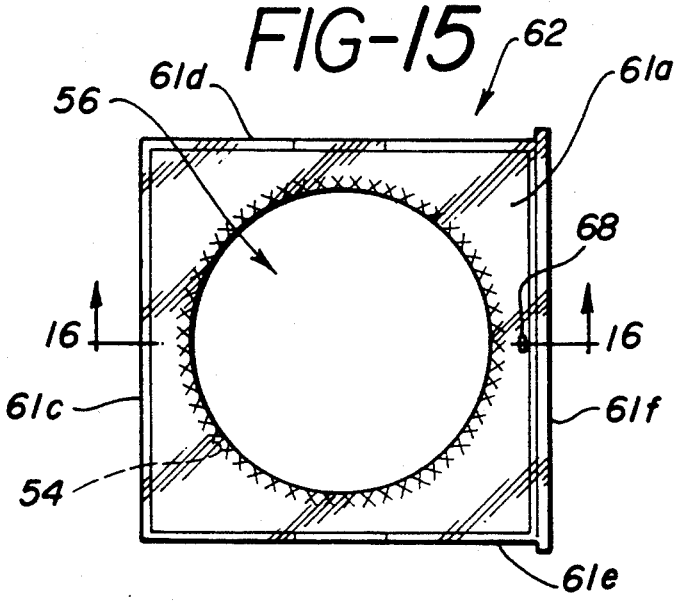
FIG. 15 is a top view of the top component of the inner element.
Figure 17:
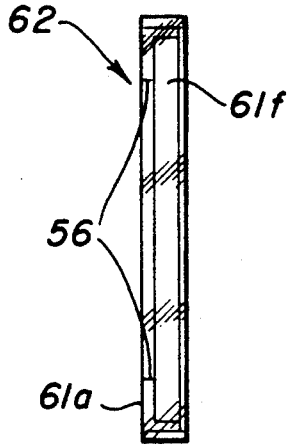
FIG. 17 is a side elevational view of the top component of the inner element of FIG. 15.
Figure 16:
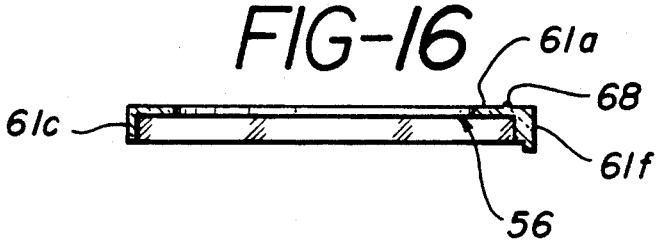
FIG. 16 is a cross-sectional view of the top component of the inner element of FIG. 15 at line 16—16.
Figure 18:
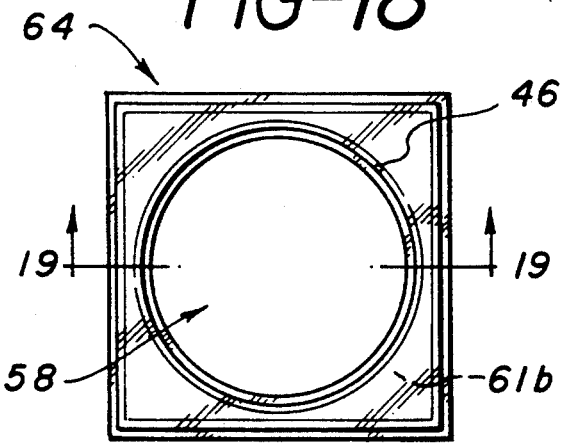
FIG. 18 is a top view of the bottom component of the inner element.
Figure 19:
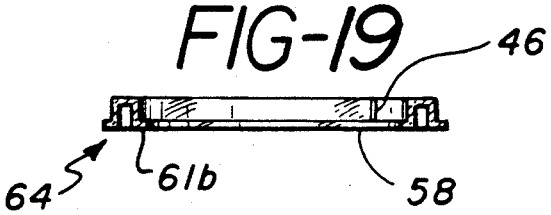
FIG. 19 is a cross-sectional view of the bottom component of the inner element of FIG. 18 at line 19—19.
Figure 20:
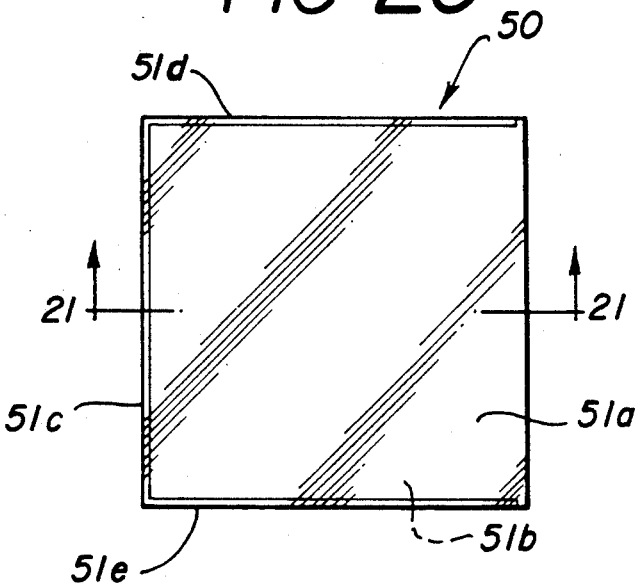
FIG. 20 is a top view of the outer cover.
Figure 22:
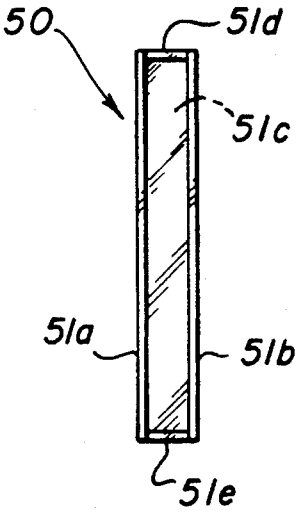
FIG. 22 is a side elevational view of the outer cover of FIG. 20.
Figure 21:
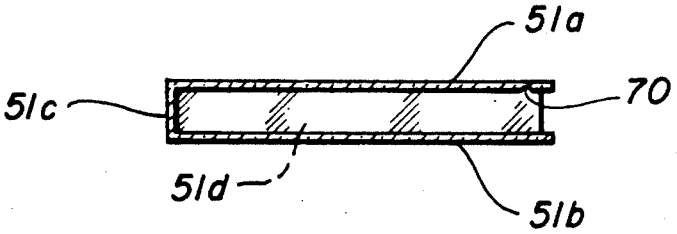
FIG. 21 is a cross-sectional view of the outer cover of FIG. 20 at line 21—21.

Fourth, fifth, sixth and seventh configurations of the second embodiment, FIGS. 9-12, respectively, include a certificate 36 sealed in container 30 along with collectable item 16. Certificate 36 may be positioned between covers 32, 34, as in FIG. 9, or between at least one cover 32, 34 or inner element component 62, 64 and reflective means for viewing, as shown in FIG. 12. Certificate 36 may include indicia 38 relating to grade, authenticity, identification or other information. Preferably of paper, certificate 36 may, however, be made of any sheet material 48 upon which indicia 38 may be registered. FIG. 12 shows the preferred configuration of the second embodiment wherein the certificate 36 is enclosed in inner element 60, and inner element 60 is, in turn, removably placed in outer cover 50.

Indicia may, alternatively, be etched into a surface of one or more of covers 32, 34, or directly applied thereto, rather than being printed on certificates 36 or sheet material 48.

Figure 9:
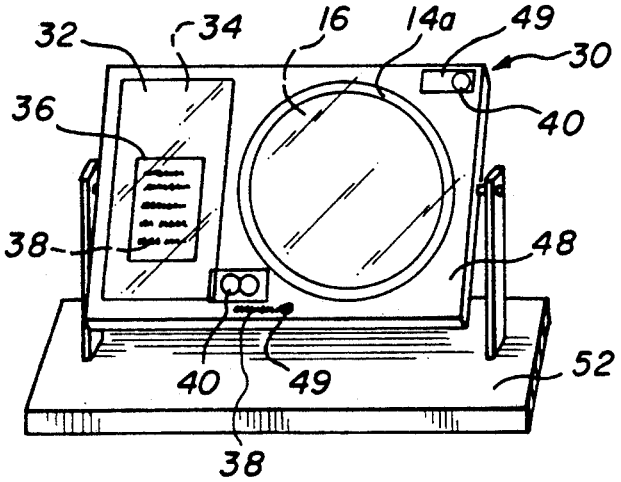
FIG. 9 is a front perspective view of the container of the present invention in a fourth configuration shown with a display stand.
Figure 10:
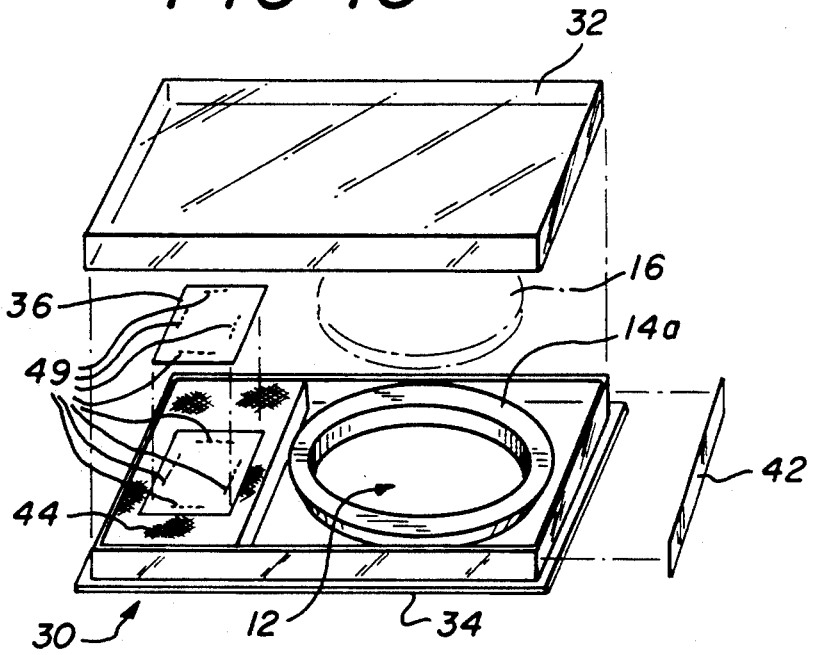
FIG. 10 is an exploded perspective view of the second embodiment of the container of the present invention in a fifth configuration.
Figure 11:
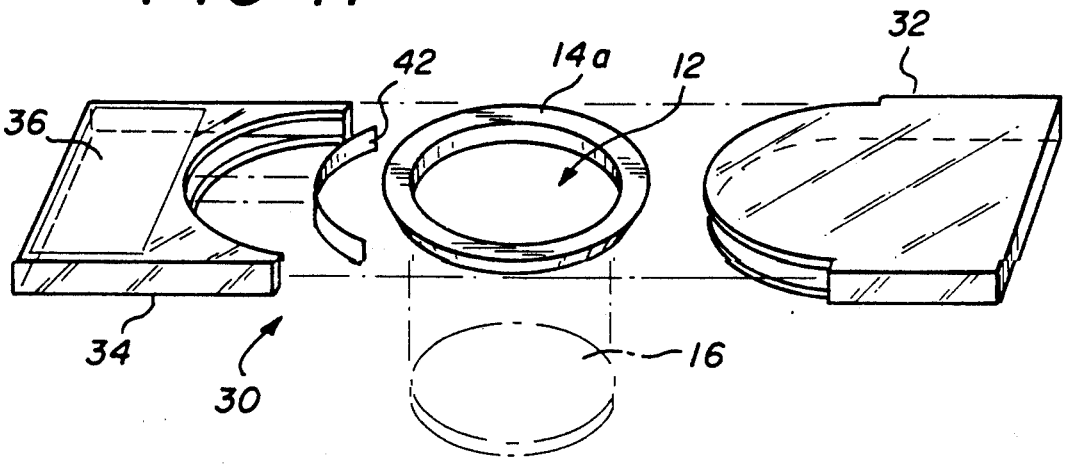
FIG. 11 is an exploded perspective view of the second embodiment of the container of the present invention in a sixth configuration.

The present invention further includes means for displaying container 30 (or 10), as representatively shown in FIG. 9, where container 30 is mounted on display stand 52.

In accordance with the second embodiment of the present invention where at least two container components are provided, a more secure structure for a collectable item may result. Not only may cavity 12 be entirely enclosed and sealed between components, for example by ultrasonic bonding, additional safety features are possible. Where two or more opposing surfaces are presented, there may be provided therebetween one or more of various means for preventing undetected access to cavity 12 or to certificate 36, or other means for preventing undetected separation of container components.

Means for preventing undetected access to cavity 12 or certificate 36 include tamper-evident means for permanently indicating separation of container components, such as thin-film tapes 42,.optically variable coatings 44 or other related devices or means. Such thin-film tapes 42, coatings 44 and related devices or means irreversibly disrupt, are destroyed, become unreadable, or change color when the opposing surfaces are separated, for example as when access to cavity 12 or certificate 36 is sought. Representing such means for preventing undetected access, thin-film tapes 42 and optically variable coatings 44 are variously shown between opposing surfaces in FIGS. 6, 7 and 10–12.

Other means for preventing undetected access to cavity 12 or certificate 36 include mechanical package design and certificate design, either of which may include complex or detailed features which are difficult to counterfeit or reproduce. For example, joints between container components or inner element components may be complex, with grooves or notches (not shown). Another means for preventing undetected access, such as by hot-wire or other cutting methods, comprises metal pins 46 located in one or more container components, representatively shown in FIG. 12 in inner element 60. Pins 46 of non-circular cross-section, dimensioned to not penetrate the outer surface of inner element 60, are preferred to prevent removal by drilling.

Still other means for preventing undetected access include designing the container components, such as the inner element container components, so that disassembly of the components renders them unusable. By selectively weakening specific areas (not shown) of those components and joining them with ultrasonic bonds at various points, separation of container components will result in the fracture thereof. Finally, a sheet material 48, as shown in FIGS. 9 and 12, or certificate 36 may be placed between and adhered with adhesive 49 to two or more container components which will be destroyed upon separation of the container components, thus destroying not only an identifying feature of container 30 but leaving residue adhered to the components.

Means to prevent counterfeiting of the container components may include areas of design on one or more container components. For example, a frosted, etched or milled design 54 of complex or detailed features may be located on the inner surface of a container component, for example, an annular area of design around a viewing aperture 56 (or 58) on inner element 60 as in FIG. 12, or around a viewing face 26 or 28 (not shown). Typically, these features are introduced into the container during molding of the specific plastic components, where the complex design features have been etched into the mold cavity for transfer to the plastic part. The inside edges of the viewing aperture 56 or 58 may also have design 54 placed thereon.

As a further means to prevent counterfeiting, indicia 38 may be printed or placed on the container components or various tamper-evident means, adding to the burden of replication. Where indicia 38 are placed on thin-film tapes 42 or optically variable coatings 44 or other devices, the indicia 38 will be irreversibly and visually damaged when the inner element components are separated. Further, when indicia 38 are printed on paper certificates 36 or sheet material 48, bleeding inks or laser printing may be used. As representatively shown by security designs 40 in FIG. 9, sheet material 48 may be security paper, or may include dyed designs, water marks, low wet-strength or may have propensities for irregular tearing. Such features will discourage alteration, as the certificate substrate will be irreversibly changed through such processes. As representatively shown in FIGS. 9, 10 and 12 indicia 38 on certificate 36 or designs 40 on sheet material 48 may also be obliterated upon separation of the inner element components by placing clear adhesives 49 on the certificates 36 or sheet material 48. Adhesives 49 may be applied on at points on surfaces where information or designs are printed, or on both top and bottom surfaces of the certificate 36 or material 48.

Referring to FIG. 12, the preferred configuration of the second embodiment, shown in exploded view, will be discussed in greater detail. All parts shown are preferably of commercially available materials. In the preferred embodiment, cover 50 encloses inner element 60. Inner element 60 is comprised of top and bottom inner element components 62 and 64, respectively, which are assembled, as shown, to retain collectable item 16, shown in phantom for reference, and grading certificate 36 therebetween. (See also FIGS. 13 and 14). Adhesive 49, preferably transparent, is shown typically applied to secure grading certificate 36 to both the top and bottom inner element components 62 and 64, to cause certificate 36 to be torn if top and bottom inner element components 62 and 64 are separated after initial assembly. Also shown typically, aperture 66 in grading certificate 36 permits tamper-evident devices, such as thin-film tape 42, to adhere to both the top and bottom inner element components 62 and 64. The thin-film tape 42 may also extend beyond aperture 66 to adhesively attach to a portion of grading certificate 36. This technique serves to cause the same tearing action upon separation of inner element components 62 and 64 as noted above.

Top and bottom inner element components 62, 64 are preferably injection molded as single pieces, as shown respectively in FIGS. 15–17 and 18–19, and joined, preferably, by ultrasonic bonding. So joined, they form inner element 60 having top and bottom walls 61*a* and 61*b*, and side walls 61*c*–61*f*. Similarly, outer cover 50 is preferably fabricated by injection molding, but as a single unit, as shown in FIGS. 12 and 20–22. Outer cover 50 has top and bottom walls 51*a* and 51*b*, and side walls 51*c*–51*e*, as shown. When inner element 60 is inserted in outer cover 50 to form container 30 they too are also preferably joined together by ultrasonic bonding.

Still referring to FIG. 12 for a typical assembly of container 30, when container 30 is assembled, tamper-evident means, preferably a section of thin-film tape 42 including a double-sided transparent adhesive layer, is placed between and in contact with both the inner surface of side wall 51*c* of outer cover 50 and the outer surface of side wall 61*c* of inner element 10. Once outer cover 50 engages inner element 60, any separation of the two will cause thin-film tape 42 to distort, destruct, become unreadable or change color, permanently evidencing such separation.

The inner element 60 may be retained in outer cover 50 by any number of methods, including a friction fit (not shown), pin and hole combinations (not shown), or nub 68 and recess 70 (shown in FIGS. 15, 16 and 21) which is preferred between inner element 60 and outer cover 50. Friction fit may be enhanced by providing a slight taper to outer cover 50, narrowing from its mouth to its closed end.

With reference to FIG. 12, when assembled, container 30 permits viewing of both faces and the periphery of cavity 12. Apertures 56 and 58 in inner element 60 permit direct viewing of opposing faces an item in cavity 12 if inner element 60 is removed from outer cover 50. If container 30 comprises a coin holder, it is preferably of standard size for numismatists, nominally two inches by two inches square.

Indicia 38 appearing on certificate 36 (or sheet material 48, inner surfaces of the inner element, or on tamper-evident tape 42) such as alphanumeric or bar code data, is visible through side walls 51*c–e* and 61*c–f* of the outer cover and inner element, respectively.

Figure 23:
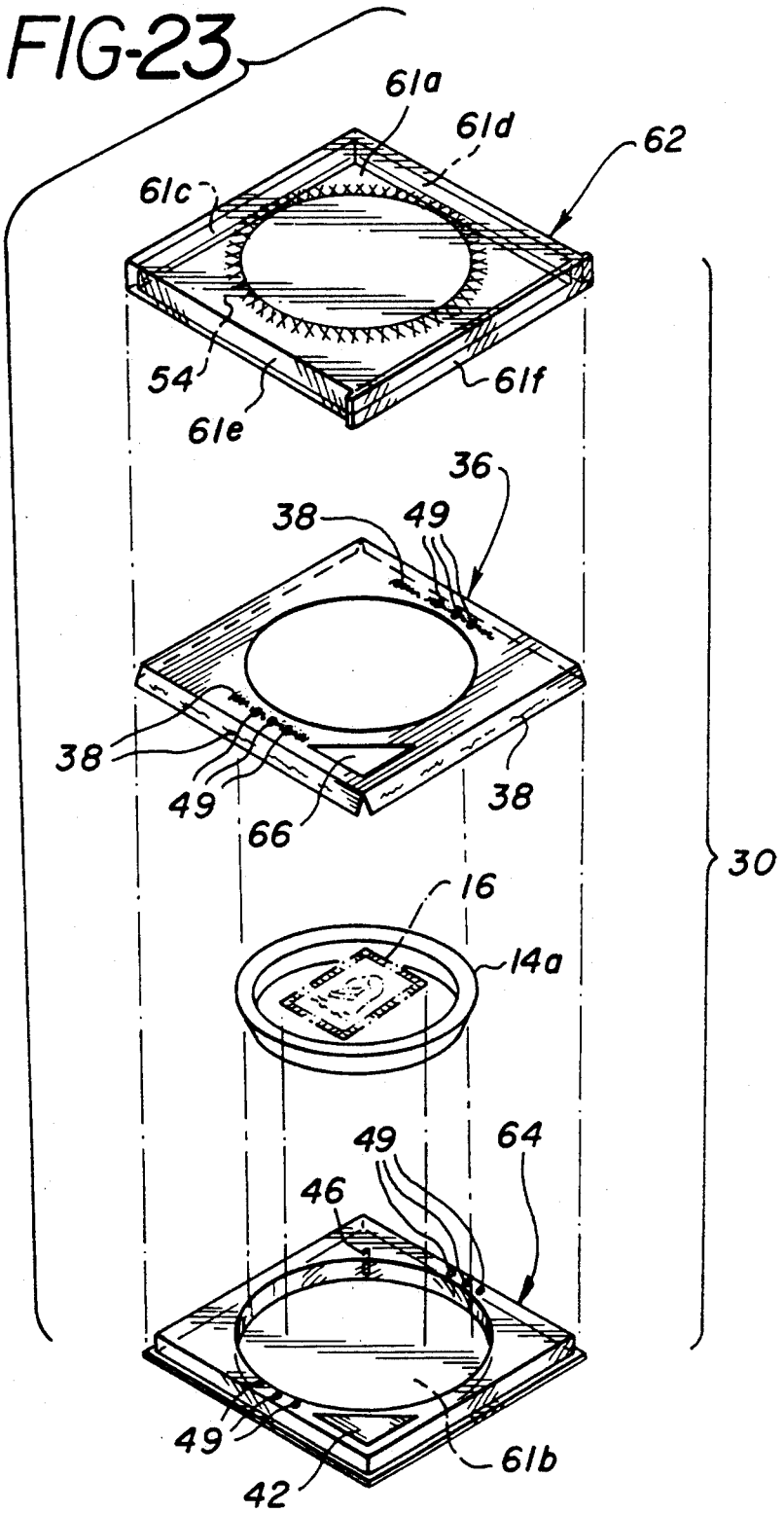
FIG. 23 is an exploded perspective view of the eighth configuration of the container of the present invention.

While certain representative embodiments and details have been shown and described for purposes of illustrating the invention, it will be apparent to those skilled in the art that various changes in the device disclosed herein may be made without departing from the scope of the invention which is defined in the appended claims. For example, in FIG. 12, aperture 56 in inner element component 64, and aperture 58 in inner element component 62 may be eliminated, thus completely enclosing the space between top and bottom walls 61*a* and 61*b* to form container 30 as shown in FIG. 23. In FIG. 23 like numbers relate to like elements shown in FIGS. 12–22. Cavity 12 thus formed certificate 36 may then be used in connection with the analysis, transport, display and tamper-resistant storage of other small and moderately sized collectable items 16.

What is claimed is:

1. A container for one or more collectable items, said container comprising one or more container components defining a cavity wherein at least one collectable item may be placed, and wherein at least one of said one or more container components comprises one or more reflective means for viewing at least a portion of said cavity by reflection, said one or more reflective means for viewing comprising at least one reflecting prism.

2. A container as recited in claim 1 wherein said at least one reflecting prism surrounds at least a portion of said cavity.

3. A container as recited in claim 1 wherein said at least one reflecting prism is a prismatic ring.

4. A container as recited in claim 1 wherein said at least one reflecting prism has at least one straight segment.

5. A container as recited in claim 1 wherein said at least one reflecting prism is comprised of clear, transparent material capable of internally reflecting light.

6. A container as recited in claim 1 wherein said at least one reflecting prism has 3 or more faces.

7. A container as recited in claim 6 wherein said faces are substantially planar.

8. A container as recited in claim 7 wherein at least one of said faces is convex.

9. A container as recited in claim 7 wherein at least one of said faces is concave.

10. A container as recited in claim 1 further comprising a reflective coating on at least one surface of said at least one reflecting prism.

11. A container as recited in claim 1 wherein said one or more reflective means for viewing comprises one or more mirrored surfaces.

12. A container as recited in claim 11 wherein said one or more mirrored surfaces comprise a reflective silver coating on at least one surface of said reflective means for viewing.

13. A container as recited in claim 12 wherein said one or more mirrored surfaces surround at least a portion of said cavity.

14. A container as recited in claim 1 wherein said one or more reflective means for viewing surrounds said cavity and comprises a means for simultaneously viewing the entire periphery of said cavity.

15. A container as recited in claim 1 wherein said cavity extends generally centrally through said reflective means for viewing.

16. A container as recited in claim 1 comprising two or more cavities.

17. A container as recited in claim 1 wherein said cavity further comprises means for retaining a collectable item therein.

18. A container as recited in claim 18 wherein said means for retaining comprises one or more tabs extending into said cavity.

19. A container as recited in claim 1 for one or more collectable items, said container comprising:

two or more container components; and means for joining said two or more container components.

20. A container as recited in claim 20 wherein said one or more reflective means for viewing comprises one or more reflecting prisms surrounding at least a portion of said cavity.

21. A container as recited in claim 20 wherein said one or more reflective means for viewing comprises two reflecting prisms disposed to reflect a view of at least a portion of said cavity to opposite sides of said container.

22. A container as recited in claim 20 wherein said one or more reflective means for viewing comprise one or more mirrored surfaces surrounding at least a portion of said cavity.

23. A container as recited in claim 20 wherein said one or more reflective means for viewing comprise one or more reflecting prismatic rings, and wherein said cavity extends generally centrally through said one or more reflecting prismatic rings.

24. A container as recited in claim 20 wherein at least a portion of one of said two or more container components comprises an outer cover enclosing at least a portion of one opening to said cavity.

25. A container as recited in claim 24 wherein said one or more reflective means for viewing are inserted inside said outer cover.

26. A container as recited in claim 20 further comprising means for preventing undetected access to said cavity.

27. A container as recited in claim 26 wherein said means for preventing undetected access comprises tamper-evident means for permanently indicating the separation of two or more of said container components.

28. A container as recited in claim 28 wherein said tamper-evident means interconnect at least portions of said two or more container components.

29. A container as recited in claim 28 wherein said tamper-evident means comprises thin-film tape.

30. A container as recited in claim 29 wherein said tamper-evident means comprises an optically variable coating.

31. A container as recited in claim 29 wherein said tamper-evident means are adapted to display identifying indicia.

32. A container as recited in claim 27 wherein said means for preventing undetected access comprises one or more selectively weakened regions on one or more of said container components whereby said one or more container components fracture upon separation thereof.

33. A container as recited in claim 27 wherein said means for preventing undetected access further comprises one or more bonds selectively joining regions of opposing surfaces of two or more of said two or more container components, whereby one or more of said container components fracture upon separation thereof.

34. A container as recited in claim 27 wherein said means for preventing undetected access to said cavity comprises a sheet of material; and means for attaching said sheet of material at one or more points to at least two of said two or more container components, whereby at least a portion of said sheet of material is destroyed upon separation of said at least two of said container components.

35. A container as recited in claim 34 wherein said means for attaching comprises an adhesive.

36. A container as recited in claim 20 further comprising a sheet of material adapted to display indicia.

37. A container as recited in claim 36 further comprising means for preventing the non-destructive removal of said sheet of material.

38. A container as recited in claim 37 wherein said sheet of material is comprised of paper and said means for preventing non-destructive removal of said sheet of material comprises further selectively attaching said sheet of material to one or more of said two or more container components.

39. A container as recited in claim 37 wherein said sheet of material comprises paper.

40. A container as recited in claim 37 further comprising means for preventing alteration of indicia on said of material.

41. A container as recited in claim 40 wherein said means for preventing alteration of indicia comprises security patterns dyed in said sheet of material.

42. A container as recited in claim 41 wherein means for preventing alteration of indicia comprises printing with bleeding inks.

43. A container as recited in claim 27 wherein said means for joining comprises one or more ultrasonic bonds.

44. A container as recited in claim 27 wherein said means for joining comprises one or more pins located transversely across joints between at least two of said two or more container components, said one or more pins adapted to resist cutting.

45. A container as recited in claim 44 wherein said pins have a non-circular cross-section.

46. A container as recited in claim 27 wherein said means for joining comprise complex interrelating joints.

47. A container as recited in claim 20 wherein said two or more container components are adapted to display indicia thereon.

48. A container as recited in claim 20 wherein at least one of said two or more container components further comprises means to prevent counterfeiting thereof.

49. A container as recited in claim 20 wherein said means to prevent counterfeiting comprises one or more areas of design on one or more surfaces.

50. A container as recited in claim 20 wherein at least one of said two or more container elements comprises a display stand.

51. A container as recited in claim 1, said container adapted to display, house and protect a collectable item, said container comprising:

two or more container components;

means for joining said container components such that a cavity is defined between said container components for housing a collectable item; and tamper-evident means for permanently indicating separation of said container components.

52. A container as recited in claim 1 for one or more collectable items, said container having:

two or more container components, said container comprising at least:

an outer cover; and an inner element comprising said cavity adapted to retain at least one collectable item therein, said one or more reflective means for viewing, and said inner element insertable into said outer cover; and means for removably securing said inner element in said outer cover.

53. A container as recited in claim 53 further comprising means for preventing undetected removal of all or part of said inner element from said outer cover.

54. A container as recited in claim 53 wherein said means for preventing undetected removal comprises tamper-evident means for permanently indicating separation of said container components.

55. A container as recited in claim 53 wherein said outer cover is tapered to facilitate removal of said inner element.

56. A container as recited in claim 53 wherein said inner element includes one or more apertures adapted to permit unobstructed viewing of a coin retained in said inner element when said inner element is removed from said outer cover.

57. A container as recited in claim 56 wherein a viewing area is defined around at least a portion of at least one of said one or more apertures by said reflective means for viewing.

58. A container as recited in claim 57 wherein an annular area of design is defined around at least one of said one or more apertures by said reflective means for viewing.

59. A container as recited in claim 53 wherein said means for removably securing said inner element in said outer cover comprises one or more ultrasonic bonds;

means for providing frictional ,engagement between said inner element and said outer cover; and one or more recesses in said outer cover and one or more nubs in said inner element insertable into corresponding ones of said recesses.

60. A container as recited in claim 53 wherein said inner element is comprised of two or more inner element components, and means for joining said inner element components.

61. A container as recited in claim 61 wherein said means for joining said inner element components comprise one or more ultrasonic bonds;

complex interrelating joints; and one or more pins located transversely across joints between said components, wherein said pins have a non-circular cross-section and are adapted to resist cutting.

62. A container as recited in claim 61 wherein said inner element further comprises means for preventing non-destructive separation of said inner element components.

63. A container as recited in claim 63 wherein means for preventing non-destructive separation of said components comprises one or more selectively weakened areas on at least one of said inner element components, adapted to fracture at least one of said inner element components upon separation thereof; and one or more seals between said two or more of said inner element components, said one or more seals located and adapted to fracture at least one of said inner element components upon separation thereof.

64. A container as recited in claim 61 further comprising means for preventing undetected access to said cavity.

65. A container as recited in claim 65 wherein said means for preventing undetected access to said cavity comprises tamper-evident means for permanently indicating separation of said inner element components.

66. A container as recited in claim 61 wherein said inner element further comprises a sheet of material retained between said inner element components; and means for permanently indicating the separation of one or more of said inner element components from said sheet of material.

67. A container as recited in claim 66 wherein said means for permanently indicating the separation of one or more of said inner element components from said sheet of material comprises one or more points of adhesive attaching said sheet of material to one or more of said inner element components, whereby at least a portion of said sheet of material is destroyed upon said separation of said sheet of material from said one or more inner element components.

68. A container as recited in claim 61 wherein said inner element further comprises a sheet of material retained between said inner element components, wherein said sheet of material has one or more apertures through which said inner element components may communicate; and means for permanently indicating the separation of two or more of said inner element components, said means for permanently indicating separation located at said apertures through which said components may communicate.

69. A container as recited in claim 1 for one or more collectable items wherein:

at least one of said two or more container components defines at least one viewing face;

said cavity has a peripheral area in angular relationship to said at least one viewing face; and said reflective means for viewing is positioned for viewing at least a portion of said peripheral area of said cavity from said at least one viewing face of said container.

* * * * *

UNITED STATES PATENT AND TRADEMARK OFFICE

CERTIFICATE OF CORRECTION

PATENT NO. : 5,133,451

DATED : July 28, 1992

INVENTOR(S) : Boyd et al

It is certified that error appears in the above-identified patent and that said Letters Patent is hereby corrected as shown below:

Col. 11, line 49, "claim 7" should be --claim 6--.

Col. 11, line 51, "claim 7" should be --claim 6--.

Col. 11, line 63, "claim 12" should be --claim 11--.

Col. 12, line 11, "claim 18" should be --claim 17--.

Col. 12, line 19, "claim 20" should be --claim 19--.

Col. 12, line 23, "claim 20" should be --claim 19--.

Col. 12, line 28, "claim 20" should be --claim 19--.

Col. 12, line 32, "claim 20" should be --claim 19--.

Col. 12, line 37, "claim 20" should be --claim 19--.

Col. 12, line 44, "claim 20" should be --claim 19--.

Col. 12, line 51, "claim 28" should be --claim 27--.

Col. 12, line 56, "claim 29" should be --claim 28--.

Col. 12, line 59, "claim 29" should be --claim 28--.

Col. 12, line 62, "claim 27" should be --claim 26--.

Col. 12, line 67, "claim 27" should be --claim 26--.

Col. 13, line 5, "claim 27" should be --claim 26--.

Col. 13, line 17, "claim 20" should be --claim 19--.

UNITED STATES PATENT AND TRADEMARK OFFICE

CERTIFICATE OF CORRECTION

PATENT NO. : 5,133,451

DATED : July 28, 1992

INVENTOR(S) : Boyd et al

It is certified that error appears in the above-identified patent and that said Letters Patent is hereby corrected as shown below:

Col. 13, line 28, "claim 37" should be --claim 36--.

Col. 13, line 30, "claim 37" should be --claim 36--.

Col. 13, lines 31 & 32, "said of material" should be --said sheet of material--.

Col. 13, line 36, "claim 41 wherein means" should be --claim 40 wherein said means--.

Col. 13, lines 37 & 38, "printing with" should be --printing indicia with--.

Col. 13, line 39, "claim 27" should be --claim 26--.

Col. 13, line 42, "claim 27" should be --claim 26--.

Col. 13, line 49, "claim 27" should be --claim 26--.

Col. 13, line 51, "claim 20" should be --claim 19--.

Col. 13, line 54, "claim 20" should be --claim 19--.

Col. 13, line 57, "claim 20" should be --claim 19--.

Col. 13, line 60, "claim 20" should be --claim 19--.

Col. 14, line 18, "claim 53" should be --claim 52--.

Col. 14, line 21, "claim 53" should be --claim 52--.

Col. 14, line 25, "claim 53" should be --claim 52--.

Col. 14, line 28, "claim 53" should be --claim 52--.

UNITED STATES PATENT AND TRADEMARK OFFICE

CERTIFICATE OF CORRECTION

PATENT NO. : 5,133,451

DATED : July 28, 1992

INVENTOR(S) : Boyd et al

It is certified that error appears in the above-identified patent and that said Letters Patent is hereby corrected as shown below:

Col. 14, line 37, "claim 57" should be --claim 56--.

Col. 14, line 41, "claim 53" should be --claim 52--.

Col. 14, line 45, "frictional ,engagement" should be --frictional engagement--.

Col. 14, line 51, "claim 53" should be --claim 52--.

Col. 14, line 55, "claim 61" should be --claim 60--.

Col. 14, line 64, "claim 61" should be --claim 60--.

Col. 15, line 1, "claim 63" should be --claim 62--.

Col. 15, line 12, "claim 61" should be --claim 60--.

Col. 15, line 15, "claim 65" should be --claim 64--.

Col. 15, line 19, "claim 61" should be --claim 60--.

Col. 16, line 7, "claim 61" should be --claim 60--.

UNITED STATES PATENT AND TRADEMARK OFFICE

CERTIFICATE OF CORRECTION

PATENT NO. : 5,133,451

DATED : July 28, 1992

INVENTOR(S) : Boyd et al

It is certified that error appears in the above-identified patent and that said Letters Patent is hereby corrected as shown below:

Col. 2, line 30, "At least a portion of the cavity or cavities." should be deleted.

Signed and Sealed this

First Day of February, 1994

Bruce Lehman

*Attest:*

BRUCE LEHMAN

*Attesting Officer*

*Commissioner of Patents and Trademarks*